US011473333B2

(12) United States Patent
Sykes

(10) Patent No.: US 11,473,333 B2
(45) Date of Patent: Oct. 18, 2022

(54) BARBED-WIRE T-POST INSTALLATION HOLDER SYSTEM AND METHOD

(71) Applicant: Mike Sykes, Stratford, OK (US)

(72) Inventor: Mike Sykes, Stratford, OK (US)

( * ) Notice: Subject to any disclaimer, the term of this patent is extended or adjusted under 35 U.S.C. 154(b) by 198 days.

(21) Appl. No.: 17/108,909

(22) Filed: Dec. 1, 2020

(65) Prior Publication Data

US 2022/0170288 A1 Jun. 2, 2022

(51) Int. Cl.
*E04H 17/10* (2006.01)
*E04H 17/04* (2006.01)

(52) U.S. Cl.
CPC ..... *E04H 17/10* (2013.01); *E04H 17/04* (2013.01)

(58) Field of Classification Search
CPC ..... E04H 17/02; E04H 17/04; E04H 17/045; E04H 17/10; E04H 17/12; E04H 17/124; E04H 17/24
See application file for complete search history.

(56) References Cited

U.S. PATENT DOCUMENTS 542,370 A * 7/1895 Mount ..... E04H 17/10 256/48
3,572,639 A 3/1971 Shettel
3,654,383 A * 4/1972 Wilson ..... H01B 17/145 174/163 F
3,820,758 A * 6/1974 Berg, Jr. ..... A01K 3/005 256/10
3,874,640 A 4/1975 Wagner et al.
4,077,611 A * 3/1978 Wilson ..... A01K 3/005 256/10
4,982,932 A 1/1991 Baker
5,593,142 A 1/1997 Gerhart
5,959,255 A * 9/1999 Langlie ..... H01B 17/145 256/10
D416,859 S * 11/1999 Langlie ..... D13/129
5,975,501 A * 11/1999 Berg ..... A01K 3/005 256/48
6,583,363 B1 * 6/2003 Wilson, Jr. ..... H01B 17/145 256/10
6,802,495 B1 10/2004 Schmidt
9,234,367 B2 1/2016 Kopp
10,358,840 B2 7/2019 Hiner et al.
2001/0040235 A1 11/2001 Dwyer et al.
2002/0134975 A1 * 9/2002 Hancock ..... E04H 17/12 256/47

FOREIGN PATENT DOCUMENTS

FR 2502223 A1 * 9/1982
WO WO-2010037182 A1 * 4/2010 ..... E01C 11/126

* cited by examiner

*Primary Examiner* — Jonathan P Masinick
(74) *Attorney, Agent, or Firm* — Keaty Law Firm LLC

(57) ABSTRACT

A barbed-wire t-post installation holder system and method for installing barbed wire on t-posts, providing a removable and re-useable barbed-wire t-post installation holder having a holder body, t-post clips, a post-stud notch, an extending support structure, and chamfered edges on a saddle surface. The barbed-wire t-post installation holder is removably mounted on a t-post, barbed wire is supported in place during installation, barbs pulled across during tightening are raised to the saddle surface by the chamfered edges, the barbed wire is tied to the t-post, and the barbed-wire t-post installation holder is removed to be re-used.

20 Claims, 10 Drawing Sheets

BARBED-WIRE T-POST INSTALLATION HOLDER SYSTEM AND METHOD

BACKGROUND OF THE INVENTION

This invention provides a barbed-wire t-post installation holder system and method for installing barbed wire on t-posts.

Fences of barbed wire are used extensively for various purposes including agriculture, where courses of barbed wire are usually installed between strong, braced posts with lighter t-posts placed at from eight-to-twelve-foot intervals along the fence. The barbed wire is usually available in rolls of quarter-mile length. When building or repairing a fence, the barbed wire is unrolled and placed along the row of t-posts. If the barbed wire is unrolled on the ground, it becomes entangled in rocks, plants, debris, t-posts, and itself. If the barbed wire is pulled and stretched while on the ground, frequent entanglement and snagging hampers the installation. To properly stretch the barbed wire, it should be placed very near the level at which it will be attached to the t-posts. If the barbed wire is attached to the t-posts during the initial unrolling, then it is difficult to pull the barbed wire taught because the barbs on the wire snag on whatever existing attachment device or method is used. Where more than one course of barbed wire is laid out, the problems are multiplied by the probability of the strands of wire becoming entangled with each other.

What is needed is a system and method of installing barbed-wire fencing which allows initial placement upon the row of t-posts near the levels at which the wire will be attached to the t-posts, off the ground and with separation of different courses, but which also allows for pulling and tightening of the barbed wire without the barbs snagging.

U.S. Pat. No. 3,874,640 for a "Wire Support For Use In Installing Wire To A Fence Post," issued on Apr. 1, 1975 to inventors Lawrence R. Wagner et al., provides for a wire support for use on a fence post, the wire support including a body adapted to be supported to the fence post, the body having an upper surface having a wire receiving groove therein, such that in stretching barbed wire the wire may be rested in the groove in the body and after the wire is stretched it may be raised above the body and attached to the fence post, the body including means of preventing the stretched wire from pulling back through the groove in the body.

U.S. Pat. No. 10,358,840 for "T-Post Electric Fence Insulating Devices," issued on Jul. 23, 2019 to assignee Lock Jawz LLC, provides for a t-post insulator that includes means to attach in a plurality of locations around the post. The insulator portion of the device consists of an outer surface that wraps around the t-post about 270 degrees for optimal insulation of the wire. The wire is installed through means of a snap in action from the top center of the wire around a retaining post. The wire is insulated fully regardless if installed on a straight run or a corner installation where wrapping around the t-post is required.

U.S. Pat. No. 3,572,639 for "Charged Wire Fencing," issued on Mar. 30, 1971 to inventor Ralph E. Shettel, provides for a charged wire fence line structure comprising insulator and post components of integral design that effectively simplify the construction of portable and rotation systems, while adapting to existing fence lines. The insulator selectively receives and contains the wire without being attached thereto. The supporting post offers the insulator diverse vertical position for the creation of single fence lines or multiples of fence lines spaced apart from each other to better effect the control of livestock of whatever kind.

U.S. Pat. No. 4,982,932 for a "Fence Clip Assembly," issued on Jan. 8, 1991 to inventor Wayne Baker, provides for a fence clip assembly for securing strands of fencing wire and the like to wood and metal fence posts, the assembly including a pair of ears with holes therethrough and a main body with a wire holder that may comprise a pin to lock strands of wire to a clip by insertion through aligned holes in flanges and that is removable to allow the wire to be readily released and that further includes an insulator connector to insulate supported electrical wires at the fence poles.

U.S. Pat. No. 5,593,142 for a "Stretch Thru Fastener," issued on Jan. 14, 1997 to inventor Thomas L. Gerhart, provides for the "Stretch Thru Fastener," which is a simple length of a galvanized metal or plastic round tube flared at both ends, split length wise once so it can be slipped over the fence wire, and a clamp at each end to hold the "Stretch Thru Fastener" on the post while holding wire is attached, one slight groove to fit over the small shoulder on the face of a T-shaped steel post. The "Stretch Thru Fastener" will provide a way to hold the wire to the post and allow easy passage of the wire through a holder or fastener.

U.S. Pat. No. 6,802,495 for a "Pull Through Clip for Wire Fences," issued on Oct. 12, 2004 to inventor Roland F. Schmidt, provides for a pull through fence clip that is made of a single length of rod that is bent or shaped to form a device having an axis composed of two pins located at either end and a centrally located square-shaped body. The pull through fence clip is attached to a fence post by use of a commonly available post staple clip. The use of the present invention securely attaches a section of fencing wire to a fence post while allowing the individual fence wire to freely move along the line described by its longitudinal axis. The importance of this design is that it allows the fence to flex and compensate for changing conditions without impacting the general integrity and aesthetic quality of the fence as a whole.

US Patent Application Publication No. 2001/0040235 for a "Fastener for Securing a Fence Wire to a Post," published on Nov. 15, 2001 by inventors Paul Dwyer et al., discloses a fastener for securing a fence wire to a post, the fastener comprising a base member having a clip member secured thereto and extending outwardly therefrom in an arcuate fashion to define an entrance opening and a central opening. A horizontally disposed support is secured to the base member and has its opposite ends protruding from the side of the base member so that a fastener wire may be wrapped around the post and the protruding outer ends of the support to secure the fastener to a steel post. The fastener may also be secured to a cylindrical wood or fiberglass post by means of screws or nails extending through the base member into the post.

U.S. Pat. No. 9,234,367 for a "T-Post Fence Attachment System," issued on Jan. 12, 2016 to inventor Michael Kopp, provides for a first and second of fence post bracket that function together to secure a wire fence to a t-post fence post. The brackets comprise a complimentary bracket pair that secure a portion of wire fence to a t-post and utilize existing t-post lugs and t-post flanges as support. Each bracket comprises an upstanding portion having a fastener aperture, and a hook end with an open notch. The base of the bracket extends substantially perpendicular to the upstanding portion and includes a u-shaped fitting. The fitting is configured to wrap around the exposed outer edge of a t-post flange, while the upstanding portion is configured to extend away from the post between two t-post lugs. The two brackets are fastened together to provide an enclosed area between the bracket notches and the post, wherethrough a portion of the wire fence is supported.

SUMMARY OF THE INVENTION

This invention provides a barbed-wire t-post installation holder system and method for installing barbed wire on t-posts, providing a removable and re-useable barbed-wire t-post installation holder having a holder body, t-post clips, a post-stud notch, an extending support structure, and chamfered edges on a saddle surface. The barbed-wire t-post installation holder is removably mounted on a t-post, barbed wire is supported in place during installation, barbs pulled across during tightening are raised to the saddle surface by the chamfered edges, the barbed wire is tied to the t-post, and the barbed-wire t-post installation holder is removed to be re-used.

BRIEF DESCRIPTION OF THE DRAWINGS

Reference will now be made to the drawings, wherein like parts are designated by like numerals, and wherein.

DETAILED DESCRIPTION OF THE INVENTION

Figure 1:
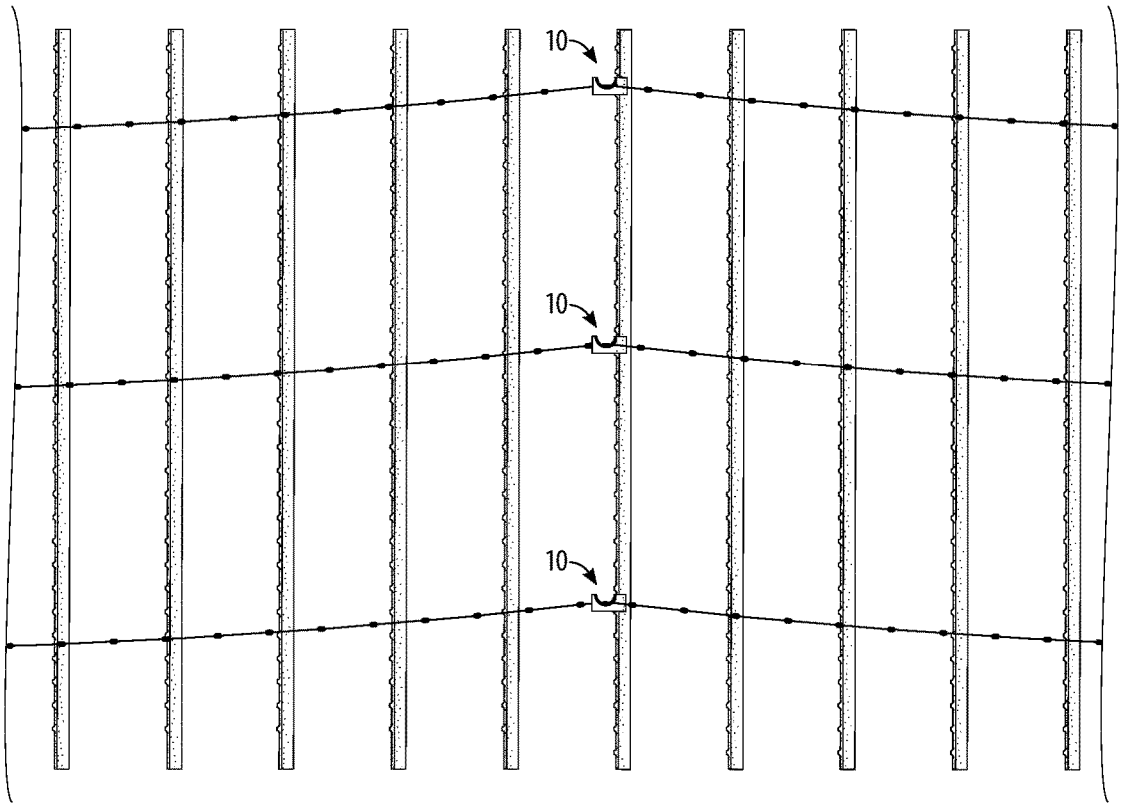
FIG. 1 is a schematic view of the barbed-wire t-post installation holder of the invention in use with three courses of barbed wire.

Referring to FIG. 1, the barbed-wire t-post installation holder 10 of the invention is intended to be used in stringing and installing barbed wire along a line of t-posts. The barbed-wire t-post installation holder 10 can be clipped to the t-posts before or during installation of the fence, and can be removed and re-used after the barbed wire is secured to the t-posts. The barbed-wire t-post installation holder 10 supports the barbed wire close to the position where it will eventually be attached to the t-post. The barbed wire being deployed is kept off of the ground, which avoids it becoming entangled, snagged, or fouled on vegetation, rocks, or other obstructions on the ground. The barbed wire being deployed is held such that the wire is not likely to coil up in loops. Where more than one course of barbed wire is being deployed, the barbed-wire t-post installation holders 10 prevent the separate courses of barbed wire from touching the others and becoming entangled or fouled. After the barbed wire being deployed is put in place in the barbed-wire t-post installation holders 10, it can be pulled tight before being secured to the t-posts. During the pulling and tightening process, the barbs on the wire will be allowed to pass over the barbed-wire t-post installation holder 10, as described in detail below.

Figure 2:
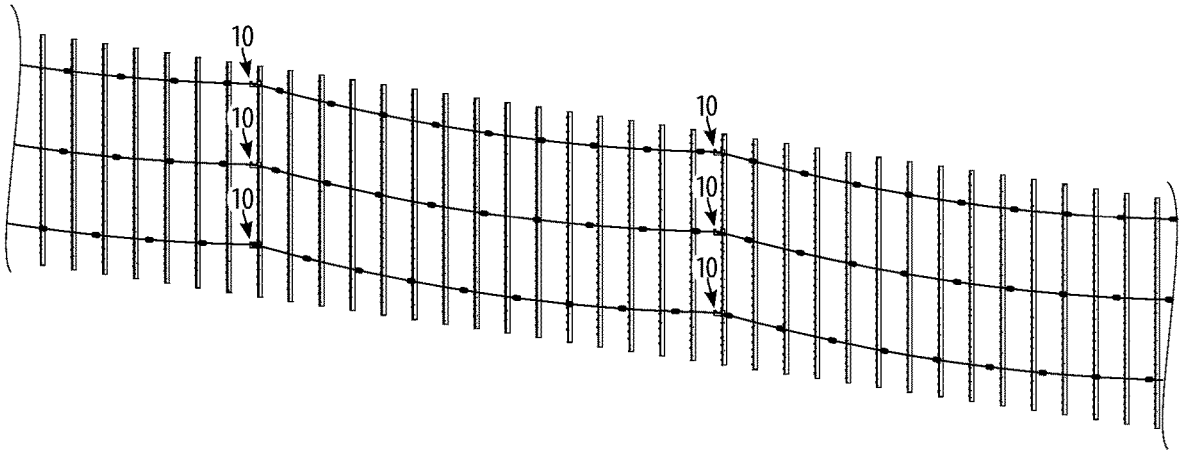
FIG. 2 is a schematic view of the barbed-wire t-post installation holder of the invention, in use, spaced along a 350-foot line of t-posts.
Figure 3:
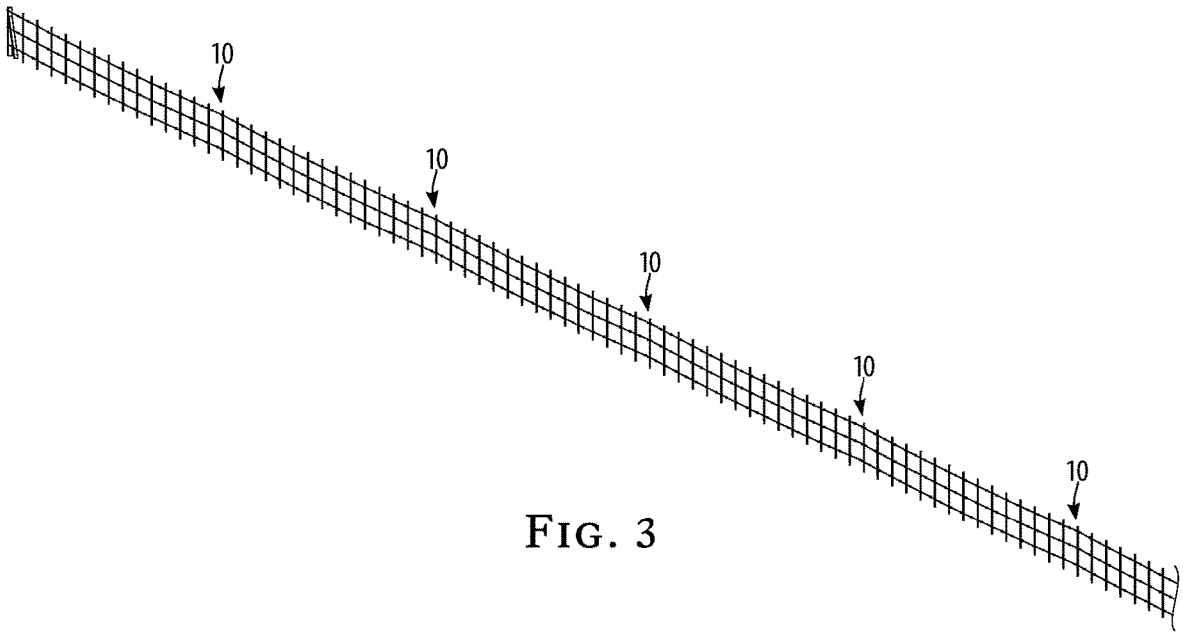
FIG. 3 is a schematic view of the barbed-wire t-post installation holder of the invention, in use, spaced along an 800-foot line of t-posts.

Referring to FIG. 2, the barbed-wire t-post installation holders 10 do not need to be placed on every t-post. Referring additionally to FIG. 3, on reasonably level terrain the barbed-wire t-post installation holders 10 can be placed approximately every 150 feet. With t-posts spaced from 8 to 12 feet apart, the barbed-wire t-post installation holders 10 can be placed at every approximately 15th t-post. Where the standard roll of barbed wire is one-quarter mile, ten barbed-wire t-post installation holders 10 will often be sufficient for each quarter-mile course of barbed wire. As the course of barbed wire is secured to the t-posts, the barbed-wire t-post installation holders 10 can be removed to be re-used for the next roll of barbed wire.

Figure 4:
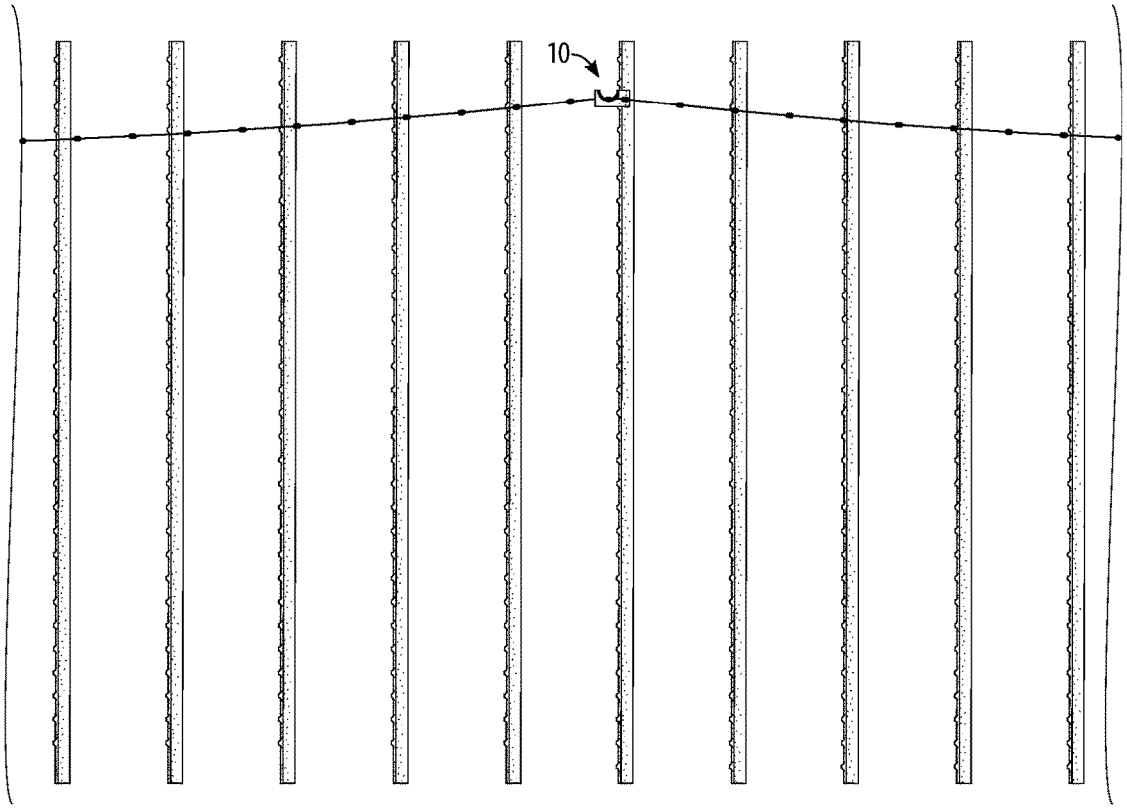
FIG. 4 is a schematic view of the barbed-wire t-post installation holder of the invention in use with one course of barbed wire.

Referring to FIG. 4, the barbed-wire t-post installation holder 10 can be used with a single course of barbed wire, or when installing one course at a time.

Figure 5:
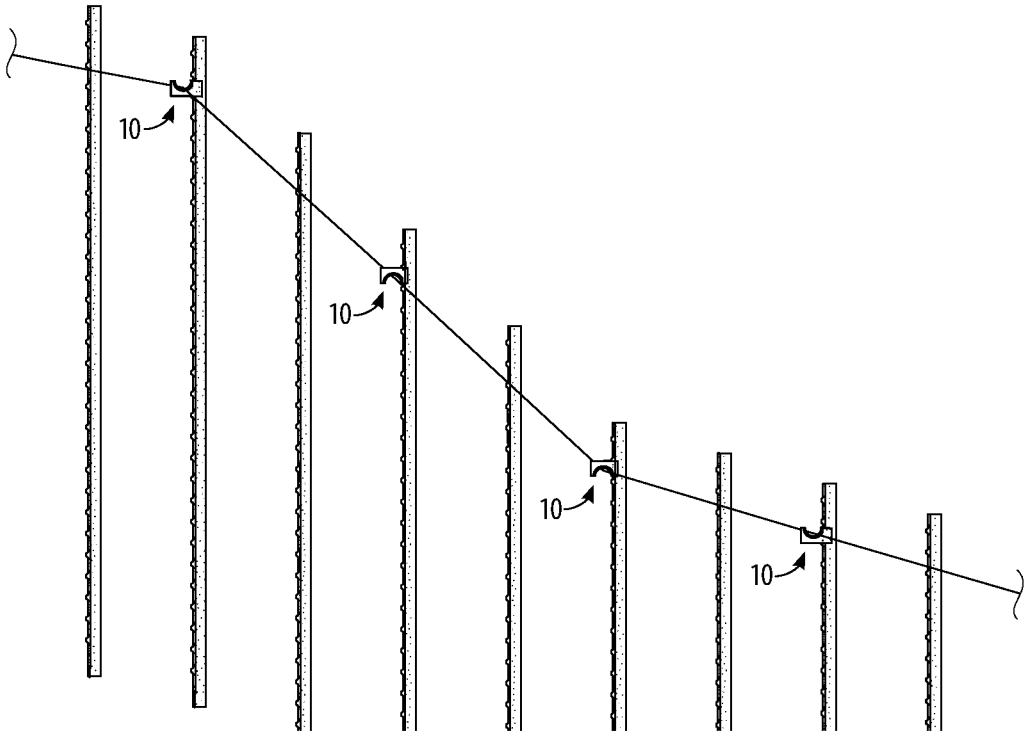
FIG. 5 is a schematic view of the barbed-wire t-post installation holder of the invention in use on sloping ground.

Referring to FIG. 5, some of the barbed-wire t-post installation holders 10 can be used in a bottom-up or 180-degree rotated orientation in circumstances where the barbed wire needs to be held down instead of up, such as installation on a slope, as shown.

Figure 6:
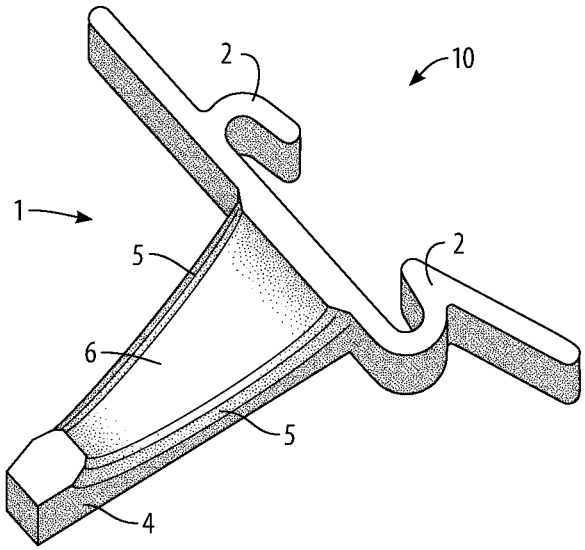
FIG. 6 is an above perspective view of the barbed-wire t-post installation holder of the invention.
Figure 7:
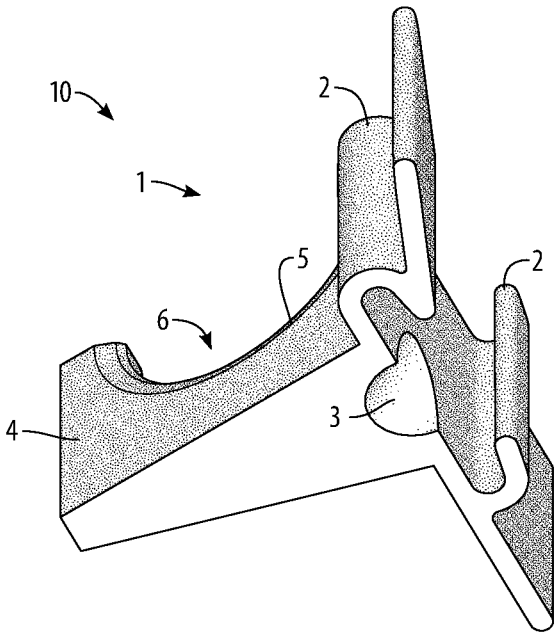
FIG. 7 is a below perspective view of the barbed-wire t-post installation holder of the invention.

Referring to FIG. 6 and FIG. 7, the barbed-wire t-post installation holder 10 provides a holder body 1 having t-post clips 2 allowing the barbed-wire t-post installation holder 10 to be snapped onto and off of a t-post. The t-post clips 2 are at the nominal back of the holder body 1. A post-stud notch 3 is provided at the nominal back of the holder body 1 and is meant to fit over and enclose a portion of a stud on the t-post, for the purpose of providing additional lateral stabilization when barbed wire is being pulled and stretched through the barbed-wire t-post installation holder 10. This stabilization can be achieved by enclosing an approximately one-half portion of the post stud, as shown, or a larger portion can be enclosed. An extending support structure 4 extends toward the nominal front of the holder body 1, as shown, providing a structure to support the barbed wire being deployed. The tapering structure shown, with a wider base toward the back of the holder body 1, provides additional lateral stabilization and provides additional material so that the removal of material for the post-stud notch 3 does not weaken the structure. A transverse trough or notch is provided through the extending support structure 4 to accommodate the barbed wire being deployed. Chamfered edges 5 are provided on the trough or notch for the purpose of facilitating the passing of the barbs on the barbed wire over a saddle surface 6, as disclosed in more detail below.

Figure 8:
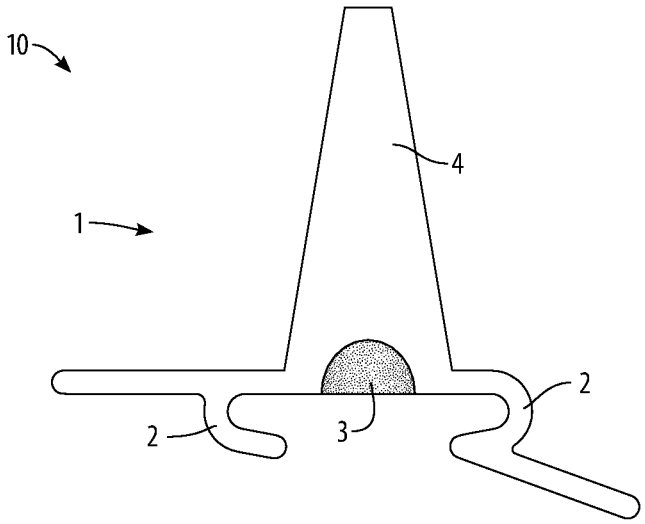
FIG. 8 is a bottom view of the barbed-wire t-post installation holder of the invention.
Figure 9:
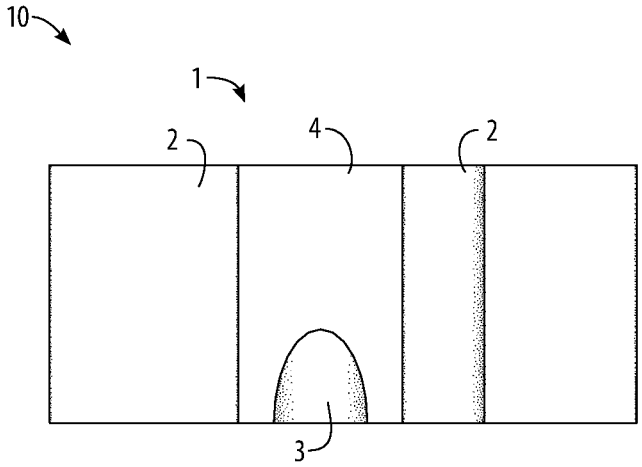
FIG. 9 is a back view of the barbed-wire t-post installation holder of the invention.

Referring to FIG. 8 and FIG. 9, the post-stud notch 3 fits over a portion of a stud on the t-post and provides additional lateral stabilization against the force of the barbs on the barbed wire being pulled through the barbed-wire t-post installation holder 10.

Figure 10:
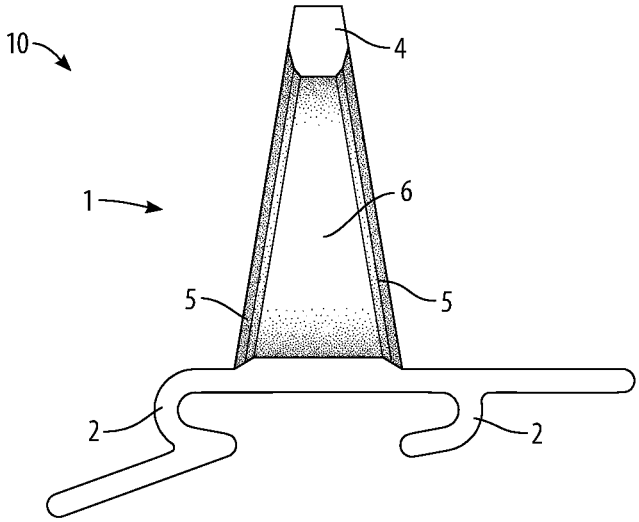
FIG. 10 is a top view of the barbed-wire t-post installation holder of the invention.
Figure 11:
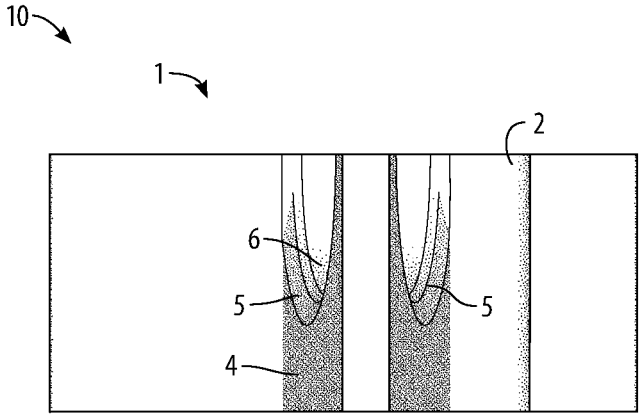
FIG. 11 is a front view of the barbed-wire t-post installation holder of the invention.

Referring to FIG. 10 and FIG. 11, the taper of the extending support structure 4 allows for greater stability at the nominal back of the holder body 1 which is in contact with the t-post, and an amount of temporary deformability toward the nominal front when in use. The chamfered edges 5 reduce the angle of the edge encountered by the barbs of the barbed wire as it is being pulled and stretched through the barbed-wire t-post installation holder 10.

Figure 12:
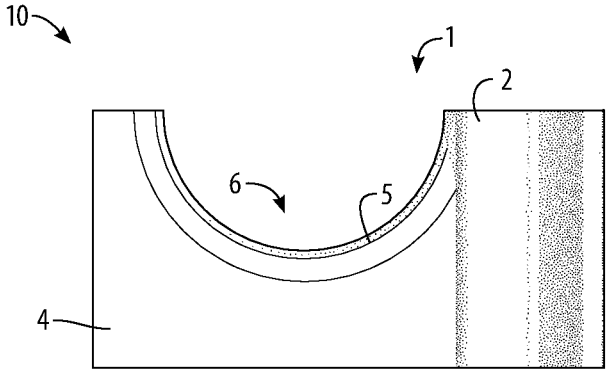
FIG. 12 is a side view of the barbed-wire t-post installation holder of the invention.
Figure 13:
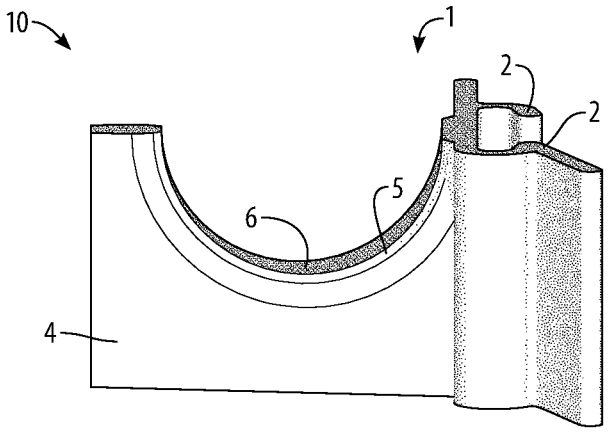
FIG. 13 is a side perspective view of the barbed-wire t-post installation holder of the invention.

Referring additionally to FIG. 12 and FIG. 13, one or more steps of chamfer can be provided, such as the two-step chamfer shown. An advantage of the multi-step chamfer is the avoidance of presenting a single large, chamfered face for an oncoming barb to dig into and become embedded, but rather presenting a series of faces forming incremental ramps. The chamfer should be sized such that the barbs of the barbed wire being pulled through the barbed-wire t-post installation holder 10 will contact the chamfer and not become caught on the outer surface of the extending support structure 4. For most barbed wire, a chamfer extending at least ⅜ inch, or 1 centimeter should be sufficient. Between the two chamfered edges 5 is a saddle surface 6 which supports the barbed wire during the installation process. The width of the saddle surface 6, which tapers as shown, should be sufficiently wide in the middle section such that when the leading tip of a barb is being pulled across the saddle surface 6 after being pulled up over the chamfered edge 5, that leading tip of the barb does not run off of the saddle surface 6 and start lowering until after the other tips of the same barb are also at the level of the saddle surface 6.

The barbed-wire t-post installation holder 10 can be made of a plastic or rubber having sufficient hardness while still allowing the temporary deformations of the material required to snap the t-post clips 2 onto and off of the t-post, and to allow temporary deformation of the extending support structure 4 when a barb is pulled across. High-density polyethylene (HDPE) has the proper strength-to-density ratio and is also somewhat self-lubricating, which is an advantage here.

Figure 14:
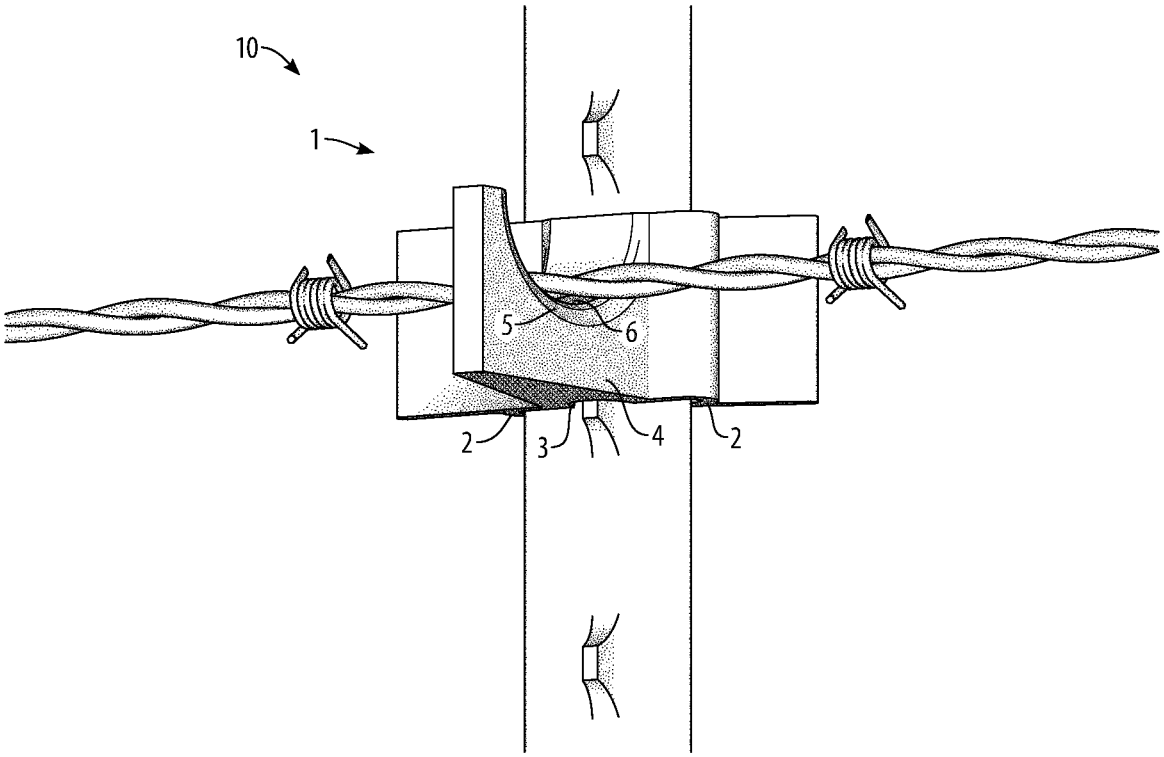
FIG. 14 is a perspective view of the barbed-wire t-post installation holder of the invention in use.

Referring to FIG. 14, in use, when a length of barbed wire to be deployed is resting upon the barbed-wire t-post installation holder 10, or when a non-barbed section of the wire is being pulled across, the wire rests upon or slides across the saddle surface 6 of the extending support structure 4. If the barbed wire is sufficiently taught and ready to be secured to the t-post, then the barbed-wire t-post installation holder 10 can be removed and the barbed wire can be secured to the t-post, usually with a metal wire tie. The removed barbed-wire t-post installation holder 10 can be re-used for later installations or later phases of the installation.

Figure 15:
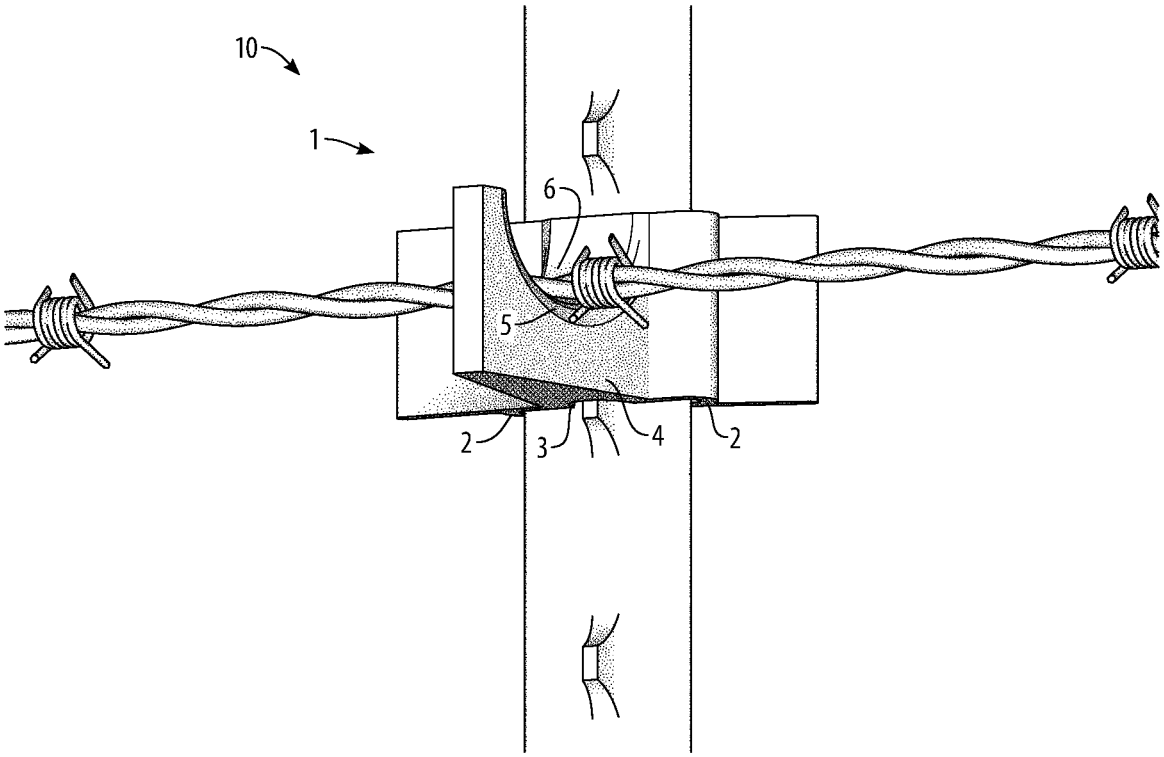
FIG. 15 is a perspective view of the barbed-wire t-post installation holder of the invention in use.

Referring to FIG. 15, in use, when a length of barbed wire to be deployed is being pulled across the barbed-wire t-post installation holder 10, such as when pulling the wire taught for installation, the oncoming barb contacts the chamfered edge 5, and not the side of the extending support structure 4, where it would likely encounter too much resistance and would instead dig in. As the barb applies transverse linear force against the chamfered edge 5 of the extending support structure 4, that force is countered by the grip of the t-post clips 2 against the t-post, and additionally by the stud of the t-post partially enveloped by the post-stud notch 3. The barbed-wire t-post installation holder 10 transfers some of the linear force into torsional force upon the t-post itself, and the t-post will deflect somewhat in response both the linear and the torsional forces. The deflection of the t-post alters the effective angle of contact between the barb and the chamfered edge 5 of the extending support structure 4, promoting the sliding of the barb as opposed to its digging into the chamfered edge 5. In addition to the deflection of the t-post, the extending support structure 4 will also deflect somewhat, further altering the angle of contact and further promoting sliding of the barb.

Figure 16:
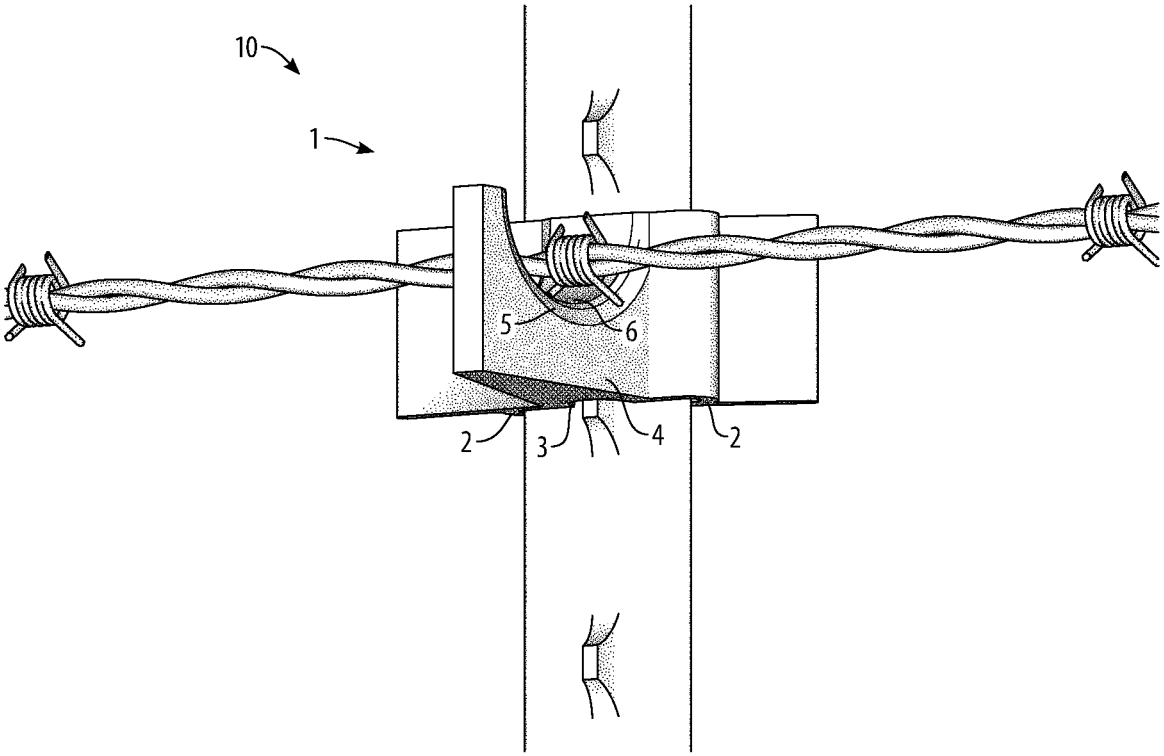
FIG. 16 is a perspective view of the barbed-wire t-post installation holder of the invention in use.

Referring to FIG. 16, in use, after a barb on a wire that is being pulled across the barbed-wire t-post installation holder 10 has been pulled up over the chamfered edge 5, which has been deflected to promote this action, the torsional force on the t-post and the transverse force on the extending support structure 4 relax and the t-post and barbed-wire t-post installation holder 10 return to an undeflected position, while the barb of the barbed wire to be deployed slides across the saddle surface 6 of the barbed-wire t-post installation holder 10.

In use, under many conditions, the barbed-wire t-post installation holder 10 is likely to provide a ratcheting effect during pulling and tightening of barbed wire for fence installation, because moving a barb up over a chamfered edge 5 usually requires the application of enough pulling force to temporarily deflect the t-post and the extending support structure 4. After the barb passes and the t-post and extending support structure 4 return, then the barb is unlikely to slide back across the barbed-wire t-post installation holder 10 in the absence of significant pulling in the other direction. On the other hand, if a section of barbed wire were to be overtightened, then the resulting reverse pull might be sufficient to move barbs in the other direction. If this were the case, the barbed-wire t-post installation holder 10 would be serving to relieve the effects of over-tightening of the wire.

Many other changes and modifications can be made in the system and method of the present invention without departing from the spirit thereof. I therefore pray that my rights to the present invention be limited only by the scope of the appended claims.

I claim:

1. A barbed-wire t-post installation holder system for installing barbed wire on t-posts having post studs, the barbed-wire t-post installation holder system comprising:

(i) a holder body having a top, bottom, front, back, and sides orientation;

(ii) two t-post clips at the back of said holder body adapted for removable mounting upon a t-post;

(iii) an extending support structure extending from back to front of said holder body;

(iv) a post-stud notch at the bottom back of said holder body, adapted to fit over a post stud;

(v) a saddle surface on said extending support structure facing the top and defining a trough extending from side to side; and (vi) chamfered edges between said saddle surface and each side of said extending support structure.

2. The barbed-wire t-post installation holder system of claim 1, where said holder body is made from high-density polyethylene (HDPE).

3. The barbed-wire t-post installation holder system of claim 1, where said holder body is made from plastic.

4. The barbed-wire t-post installation holder system of claim 1, where said chamfered edges are sized large enough to accommodate barbs of the barbed wire.

5. The barbed-wire t-post installation holder system of claim 1, where said extending support structure further comprises a tapered profile.

6. The barbed-wire t-post installation holder system of claim 1, where said chamfered edges are at least three-eights-inch size.

7. The barbed-wire t-post installation holder system of claim 1, where said chamfered edges further comprise more than one step of chamfer.

8. The barbed-wire t-post installation holder system of claim 1, where said saddle surface is of sufficient width to avoid lowering a leading tip of a barb before another tip of that barb rests upon said saddle surface.

9. The barbed-wire t-post installation holder system of claim 1, further comprising adaptation to change an effective angle of contact of said chamfered edges when the t-post is deflected by the force of a barb.

10. The barbed-wire t-post installation holder system of claim 1, further comprising adaptation to change an effective angle of contact of said chamfered edges when said extending support structure is deflected by the force of a barb.

11. A barbed-wire t-post installation holder method for installing barbed wire on t-posts having post studs, the barbed-wire t-post installation holder method comprising:

(i) providing a barbed-wire t-post installation holder comprising:
  (a) a holder body having a top, bottom, front, back, and sides orientation;
  (b) two t-post clips at the back of said holder body adapted for removable mounting upon a t-post;
  (c) an extending support structure extending from back to front of said holder body;
  (d) a post-stud notch at the bottom back of said holder body, adapted to fit over a post stud;
  (e) a saddle surface on said extending support structure facing the top and defining a trough extending from side to side; and
  (f) chamfered edges between said saddle surface and each side of said extending support structure;

(ii) removably mounting said barbed-wire t-post installation holder upon a t-post;

(iii) engaging a post stud with said post-stud notch;

(iv) placing barbed wire upon said saddle surface;

(v) pulling the barbed wire over said saddle surface, where barbs on the barbed wire contact said chamfered edges and are raised toward said saddle surface and traverse said saddle surface;

(vi) tying the barbed wire to the t-post;

(vii) removing said barbed-wire t-post installation holder; and (viii) re-using said barbed-wire t-post installation holder.

12. The barbed-wire t-post installation holder method of claim 11, where said holder body is made from high-density polyethylene (HDPE).

13. The barbed-wire t-post installation holder method of claim 11, where said holder body is made from plastic.

14. The barbed-wire t-post installation holder method of claim 11, where said chamfered edges are sized large enough to accommodate the barbs of the barbed wire.

15. The barbed-wire t-post installation holder method of claim 11, where said extending support structure further comprises a tapered profile.

16. The barbed-wire t-post installation holder method of claim 11, where said chamfered edges are at least three-eights-inch size.

17. The barbed-wire t-post installation holder method of claim 11, where said chamfered edges further comprise more than one step of chamfer.

18. The barbed-wire t-post installation holder method of claim 11, where said saddle surface is of sufficient width to avoid lowering a leading tip of a barb before another tip of that barb rests upon said saddle surface.

19. The barbed-wire t-post installation holder method of claim 11, where said barbed-wire t-post installation holder further comprises adaptation to change an effective angle of contact of said chamfered edges when the t-post is deflected by the force of a barb.

20. The barbed-wire t-post installation holder method of claim 11, where said barbed-wire t-post installation holder further comprises adaptation to change an effective angle of contact of said chamfered edges when said extending support structure is deflected by the force of a barb.

* * * * *